US007984705B2

(12) United States Patent
Yang

(10) Patent No.: US 7,984,705 B2
(45) Date of Patent: Jul. 26, 2011

(54) ENGINE BRAKING APPARATUS WITH TWO-LEVEL PRESSURE CONTROL VALVES

(76) Inventor: Zhou Yang, Oak Ridge, NC (US)

( * ) Notice: Subject to any disclaimer, the term of this patent is extended or adjusted under 35 U.S.C. 154(b) by 405 days.

(21) Appl. No.: 12/348,317

(22) Filed: Jan. 5, 2009

(65) Prior Publication Data

US 2010/0170471 A1 Jul. 8, 2010

(51) Int. Cl.
*F02D 13/04* (2006.01)
*F01L 1/26* (2006.01)
*F01L 1/34* (2006.01)

(52) U.S. Cl. ..... 123/321; 123/90.22

(58) Field of Classification Search ..... 123/319–323, 123/90.15–90.18, 90.22, 90.23, 90.46
See application file for complete search history.

(56) References Cited

U.S. PATENT DOCUMENTS

| | | | |
|---|---|---|---|
| 2,380,051 | A | 4/1943 | Kettering |
| 3,140,698 | A | 7/1964 | Voorhies |
| 3,220,392 | A | 11/1965 | Cummins |
| 3,367,312 | A | 2/1968 | Jonson |
| 3,786,792 | A | 1/1974 | Pelizzoni |
| 3,809,033 | A | 5/1974 | Cartledge |
| 4,251,051 | A | 2/1981 | Quenneville |
| 4,677,723 | A | 7/1987 | Greene |
| 4,836,162 | A | 6/1989 | Melde-Tuczai |
| 4,924,821 | A | 5/1990 | Teerman |
| 5,150,672 | A | 9/1992 | Fischer |

(Continued)

FOREIGN PATENT DOCUMENTS

JP 09317421 A * 12/1997 ..... 123/321

(Continued)

OTHER PUBLICATIONS

U.S. Appl. No. 12/854,716, filed Aug. 11, 2010, Yang.

(Continued)

*Primary Examiner* — Willia Wolfe, Jr.
(74) *Attorney, Agent, or Firm* — Squire, Sanders & Dempsey (US) LLP

(57) ABSTRACT

Apparatus and method are disclosed for converting an internal combustion engine from a normal engine operation (20) to an engine braking (or retarding) operation (10). The apparatus has an actuation means (100) containing two braking pistons (160) slidably disposed in the valve bridge (400) between an inoperative position (0) and an operative position (1). The apparatus also has a flow control valve (50) for supplying control fluid to the actuation means (100) with two levels of pressure. At the first level or lower pressure, the braking pistons (160) will stay in the inoperative position (0), and a gap (234) is formed between the valve bridge (400) and the exhaust valves (300) to skip the motion from the lower portion of the cam (230) for the normal engine operation (20). At the second level or higher pressure, the braking pistons (160) will be moved to the operative position (1), and a linkage is formed between the valve bridge (400) and the exhaust valves (300) so that the motion from the whole cam (230) can be transmitted to the valves (300) for the engine braking operation (10). The apparatus also includes a supporting means (250) for preventing any no-follow of the valve train components and a resetting means (150) for modifying the valve lift profile (220*v*) generated by the cam (230). The supporting means (250) does not impose any force on the braking pistons (160), while the resetting means (150) stays at the off or draining position during the normal engine operation (20).

16 Claims, 8 Drawing Sheets

U.S. PATENT DOCUMENTS

| | | | | |
|---|---|---|---|---|
| 5,477,824 | A | 12/1995 | Reedy | |
| 5,564,385 | A | 10/1996 | Hakansson | |
| 5,626,116 | A | 5/1997 | Reedy | |
| 5,829,397 | A | 11/1998 | Vorih | |
| 6,152,104 | A | 11/2000 | Vorih | |
| 6,189,504 | B1 | 2/2001 | Israel | |
| 6,234,143 | B1 | 5/2001 | Bartel | |
| 6,237,551 | B1 * | 5/2001 | Macor et al. | 123/90.15 |
| 6,244,257 | B1 | 6/2001 | Hu | |
| 6,253,730 | B1 | 7/2001 | Gustafson | |
| 6,415,752 | B1 | 7/2002 | Janak | |
| 7,013,867 | B2 * | 3/2006 | Rammer et al. | 123/321 |
| 7,789,065 | B2 * | 9/2010 | Yang | 123/321 |
| 7,905,208 | B2 * | 3/2011 | Ruggiero et al. | 123/90.22 |
| 7,909,015 | B2 * | 3/2011 | Yang | 123/321 |
| 2002/0174849 | A1 | 11/2002 | Ruggiero | |
| 2005/0211206 | A1 | 9/2005 | Ruggiero | |
| 2006/0081213 | A1 * | 4/2006 | Yang et al. | 123/321 |
| 2007/0144472 | A1 | 6/2007 | Yang | |
| 2007/0175441 | A1 | 8/2007 | Jeong | |
| 2010/0065019 | A1 * | 3/2010 | Yang | 123/321 |

FOREIGN PATENT DOCUMENTS

| | | |
|---|---|---|
| WO | WO 90/09514 | 8/1990 |
| WO | WO 97/06355 | 2/1997 |

OTHER PUBLICATIONS

U.S. Appl. No. 12/348,320, filed Jan. 5, 2009, Yang.
U.S. Appl. No. 12/261,031, filed Oct. 30, 2008, Yang.
U.S. Appl. No. 12/217,813, filed Jul. 9, 2008, Yang, issue date Sep. 7, 2010.
International Search Report for PCT/US2009/069622, mailed Oct. 7, 2010, 6 pgs.

* cited by examiner

ENGINE BRAKING APPARATUS WITH TWO-LEVEL PRESSURE CONTROL VALVES

BACKGROUND OF THE INVENTION

1. Field of Invention

The present invention relates generally to the braking of an internal combustion engine, specifically to engine braking apparatus with two-level pressure control valves.

2. Prior Art

It is well known in the art to employ an internal combustion engine as brake means by, in effect, converting the engine temporarily into a compressor. It is also well known that such conversion may be carried out by cutting off the fuel and opening the exhaust valve(s) at or near the end of the compression stroke of the engine piston. By allowing compressed gas (typically, air) to be released, energy absorbed by the engine to compress the gas during the compression stroke is not returned to the engine piston during the subsequent expansion or "power" stroke, but dissipated through the exhaust and radiator systems of the engine. The net result is an effective braking of the engine.

An engine brake (or engine retarder) is desirable for an internal combustion engine, particularly for a compression ignition type engine, also known as a diesel engine. Such engine offers substantially no braking when it is rotated through the drive shaft by the inertia and mass of a forward moving vehicle. As vehicle design and technology have advanced, its hauling capacity has increased, while at the same time rolling and wind resistances have decreased. Accordingly, there is a heightened braking need for a diesel-powered vehicle. While the normal drum or disc type wheel brakes of the vehicle are capable of absorbing a large amount of energy over a short period of time, their repeated use, for example, when operating in hilly terrain, could cause brake overheating and failure. The use of an engine brake will substantially reduce the use of the wheel brakes, minimize their wear, and obviate the danger of accidents resulting from brake failure.

There are different types of engine brakes. Typically, an engine braking operation is achieved by adding an auxiliary engine valve event called an engine braking event to the normal engine valve event. Depending on how the engine valve event is produced, an engine brake can be defined as:

(a) Type I engine brake—the engine braking event is produced by importing motions from a neighboring cam, which generates the so called "Jake" brake;

(b) Type II engine brake—the engine braking event is produced by altering existing cam profile, which generates a lost motion type engine brake;

(c) Type III engine brake—the engine braking event is produced by using a dedicated valve lifter for engine braking, which generates a dedicated cam (rocker) brake;

(d) Type IV engine brake—the engine braking event is produced by modifying the existing engine valve lift, which normally generates a bleeder type engine brake;

(e) Type V engine brake—the engine braking event is produced by using a dedicated valve train for engine braking, which generates a dedicated valve (the fifth valve) engine brake.

The engine brake can also be divided into two big categories, i.e., the compression release engine brake (CREB) and the bleeder type engine brake (BTEB).

Conventional compression release engine brakes open the exhaust valve(s) at or near the end of the compression stroke of the engine piston. They typically include hydraulic circuits for transmitting a mechanical input to the exhaust valve(s) to be opened. Such hydraulic circuits typically include a master piston that is reciprocated in a master piston bore by a mechanical input from the engine, for example, the pivoting motion of the injector rocker arm. Hydraulic fluid in the circuit transmits the master piston motion to a slave piston in the circuit, which in turn, reciprocates in a slave piston bore in response to the flow of hydraulic fluid in the circuit. The slave piston acts either directly or indirectly on the exhaust valve(s) to be opened during the engine braking operation.

An example of a prior art CREB is provided by the disclosure of Cummins, U.S. Pat. No. 3,220,392 ("the '392 patent"), which is hereby incorporated by reference. Engine braking systems based on the '392 patent have enjoyed great commercial success. However, the prior art engine braking system is a bolt-on accessory that fits above the overhead. In order to provide space for mounting the braking system, a spacer may be positioned between the cylinder head and the valve cover that is bolted to the spacer. This arrangement may add unnecessary height, weight, and costs to the engine. Many of the above-noted problems result from viewing the braking system as an accessory to the engine rather than as part of the engine itself.

As the market for compression release-type engine brakes (CREB) has developed and matured, there is a need for design systems that reduce the weight, size and cost of such retarding systems. In addition, the market for compression release engine brakes has moved from the after-market to original equipment manufacturers. Engine manufacturers have shown an increased willingness to make design modifications to their engines that would increase the performance and reliability and broaden the operating parameters of the compression release-type engine brake.

One possible solution to the above problems is to integrate components of the braking system with the rest of the engine components. The most popular choice is to integrate the engine braking components into the engine rocker arm. The so called integrated rocker brake (IRB) devices can be found in the following U.S. Pat. Nos. 3,367,312, 3,786,792, 3,809,033, 5,564,385, 6,152,104, 6,234,143, and 6,253,730. The drawbacks of the integrated rocker brakes are the complexity and high moment of inertia due to the added engine braking components in the rocker arm, which may cause no-follow of the valve train components and other side effects on the engine performance during positive power operation.

Another engine component with integrated engine braking components is the valve bridge. One or more braking pistons can be placed in the valve bridge to form a variable valve lifter. The variable valve lifter usually contains a hydraulic linkage with lost motion means. There may be a gap in the valve lifter, for example, between the cam and the cam follower. When fluid, normally, engine oil, is supplied to the lost motion system, the valve lifter is expanded to take up the gap in the valve lifter so that the full motion from the cam is transmitted to the engine valves through the hydraulic linkage. On the other hand, if the fluid in the lost motion system is released, than the valve train will be contracted due to the gap in the valve lifter and some of the motion from the cam will be lost.

U.S. Pat. No. 5,829,397 discloses a system with a hydraulic piston in the valve bridge for controlling the amount of lost motion between an engine valve and a valve actuation means. A high speed trigger valve is used to quickly dump or supply fluid to the lost motion system so that the right amount of lost motion is accurately controlled. With such a high speed trigger valve, the continual variation of the engine valve lift is achieved. The lost motion system is operable for both engine positive power and engine braking modes of operation. However, such a full variable valve actuation (VVA) system is complex, expensive and prone to reliability issues due to the high speed trigger valve.

U.S. Patent Pub. No. 20050211206 discloses another lost motion system integrated into the valve bridge. However, a special "external" spring is needed to make the system work. The spring is mounted between the engine and the rocker arm to bias the rocker arm against a hydraulic piston into the valve bridge, so that a gap is formed between the overhead cam and the cam follower when the lost motion system is turned off. The gap is much larger than the normal valve lash, which increases the tendency of no-follow or impact of the valve train components. The special "external" spring needs to meet two conflicting requirements. First, the spring needs to be strong enough to prevent any no-follow of the valve train components even at the highest engine speed when the lost motion system is turned off. Second, because the hydraulic piston is loaded by the same spring, the spring needs to be weak enough to let the oil pressure overcome the spring force and lift up the hydraulic piston as well as the rocker arm to eliminate the gap between the cam and the cam follower when the lost motion system is turned on. The refill of the engine oil to the lost motion system could be slow due to the high spring force on the hydraulic piston, which may cause the system not fully actuated at high engine speeds. A compromise needs to be made to get the right size of the spring. However, such compromise is not ideal or even impossible when the moment of inertia of the valve train is too large, especially with the pushrod type of engines.

Another disadvantage associated with the above bridge lost motion system is that the sealing member of the resetting device is biased down against the seat by a spring, which may cause two potential problems. First, the sealing member will be impacted during both the engine braking operation (which is desirable) and the normal engine operation (not desirable). Second, the sealing member biased down against the seat by a spring keeps the control fluid sealed in the hydraulic piston chamber, which increases the potential of false start of the engine brake during the normal engine operation if there is no-follow, valve floating, excess oil leakage or other abnormal conditions.

One more challenge with the above bridge lost motion system and other integrated engine braking systems is that they may need a rather complicated system to provide two levels of oil supply pressure. The first level or lower level of oil supply pressure is for the lubrication or the hydraulic lash adjuster during the regular or positive power operation. U.S. Pat. Nos. 2,380,051, 3,140,698, 4,677,723, 4,924,821 and 5,150,672 disclosed different ways of putting one or more hydraulic pistons in the valve bridge for valve lash adjustment. The second level or higher level of oil supply pressure is for the lost motion operation. U.S. Patent Pub. No. 20070175441 uses two oil passages to supply oil, which has been widely used in the automobile industry, and may cause more oil consumption and oil pressure drop.

The flow control valve for supplying oil to an engine braking system is normally a 3-way solenoid valve, such as the one disclosed by U.S. Pat. No. 4,251,051, which has done a decent job for the traditional bolt-on engine brakes. However, there are a few drawbacks on this valve. First, the size of the valve is still too big, especially for the integrated engine braking systems. Second, the screwed-on installation may not fit on many engines where the solenoid terminals need to be specially oriented. Third, the drain port is on the bottom of the valve, while the outlet or high pressure port on the coil side, which may cause oil leakage into the coil structure on top of the flow control valve. Also, the area on the ball exposed to high pressure is too large, which requires high spring force to retain the ball and high magnetic force to actuate the valve.

U.S. Pat. No. 5,477,824 discloses a flow control valve combining the function of a traditional 3-way solenoid valve and that of a one-way check valve, trying to reduce the size and complexity of the engine braking system. However, the valve has not found commercial application because a 6 cylinder engine would need 6 new solenoid valves while only one or two of the traditional solenoid valves are enough to meet the need of the 6 cylinder engine braking. Since the solenoid valve is the most expensive and the least reliable component on an engine braking system, more solenoid valves are not desirable. Another drawback of the above solenoid valve is that the high pressure acting on the bottom of the valve causes high up-lift force on the valve, which requires high hold-down or clamping force on the valve.

It is clear from the above description that the prior-art engine brake systems have one or more of the following drawbacks:

(a) The system has high moment of inertia that may affect normal engine performance;
(b) The system causes higher no-follow tendency;
(c) The system needs a special "external" spring;
(d) The system may not be fully actuated at high engine speeds due to the force of the special "external" spring on the hydraulic piston;
(e) The system needs extra space to mount the special "external" spring;
(f) The system does not have a 2-level pressure supply solenoid valve;
(g) The system needs a leakage free and low clamping force solenoid valve; and
(h) The system needs a more compact and orientation free solenoid valve.

SUMMARY OF THE INVENTION

The engine braking apparatus of the present invention addresses and overcomes the foregoing drawbacks of prior art engine braking systems.

One object of the present invention is to provide an engine braking apparatus that eliminates the need for the special "external" spring so that there will be no large spring force acting on the braking pistons.

Another object of the present invention is to provide an engine braking apparatus that will not cause no-follow of the valve train components even at the highest engine speed.

Still a further object of the present invention is to provide an engine braking apparatus that does not increase the engine's weight and height, and is fully operational and effective at all engine speeds.

Yet another object of the present invention is to provide an engine braking apparatus with a flow control valve that is compact in size, free in mounting orientation and has two-level pressure control.

The engine braking apparatus of the present invention converts an internal combustion engine from a normal engine operation to an engine braking operation. The apparatus has an actuation means containing two braking pistons slidably disposed in the valve bridge between an inoperative position and an operative position. In the inoperative position, a gap is formed between the valve bridge and each of the two exhaust valves to skip the motion from the lower portion of the cam (including all the small braking cam lobes) for the normal engine operation. In the operative position, a linkage is formed between the valve bridge and the two valves to transmit all the cam motion for the engine braking operation.

The apparatus also has a flow control valve for supplying control fluid with two levels of pressure to the actuation means. The two levels of pressure include a first level pressure and a second level pressure. The first level pressure is lower than the second level pressure. The first level pressure is mainly for system lubrication and is not high enough to move the braking pistons from the inoperative position to the operation position. While the second level pressure is used for engine braking operation and is high enough to move the braking pistons from the inoperative position to the operation position. The flow control valve is so designed that its flow rate is maximized while the magnetic actuation force is minimized. It also has smaller size, zero leakage, orientation free and other advantages.

The apparatus also has a supporting means for preventing the exhaust valve train from having no-follow. The supporting means includes an engine valve spring and a spring seat. The spring seat holds the valve bridge between the exhaust valve lifter and the two exhaust valves so that the gap is formed and the braking pistons can move between the valve bridge and the two valves. The supporting means eliminates the no-follow issues but does not put any force on the braking pistons, which makes the engine braking operation much easier to control.

The engine brake actuation means also includes a braking spring for biasing each of the two braking pistons to the inoperative position. The braking spring has a preload on the braking pistons, which is so designed that when the control fluid from the flow control valve is at or below the first level pressure, the braking pistons will not move from the inoperative position to the operative position; but when the control fluid is at or above the second level pressure, the braking pistons will move from the inoperative position to the operative position.

The apparatus also has an engine brake resetting means for modifying the valve lift profile produced by an enlarged exhaust cam lobe during the engine braking operation. The resetting means includes a drain orifice and a resetting piston in the valve bridge. The resetting piston can move in the valve bridge between a feeding position and a draining position. In the feeding position, the resetting piston closes the drain orifice and allows the control fluid to move the two braking pistons from the inoperative position to the operative position. In the draining position, the resetting piston opens the drain orifice and drains out the control fluid to let the two braking pistons move from the operative position to the inoperative position. The resetting piston will change from the feeding position to the draining position when it is stopped by a resetting piston stop on the engine and below the resetting piston.

BRIEF DESCRIPTION OF THE DRAWINGS

These and other features or advantages of the present invention will become more apparent from the following description of the preferred embodiments in connection with the following figures.

DETAILED DESCRIPTION OF THE PREFERRED EMBODIMENTS

Reference will now be made in detail to presently preferred embodiments of the invention, examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
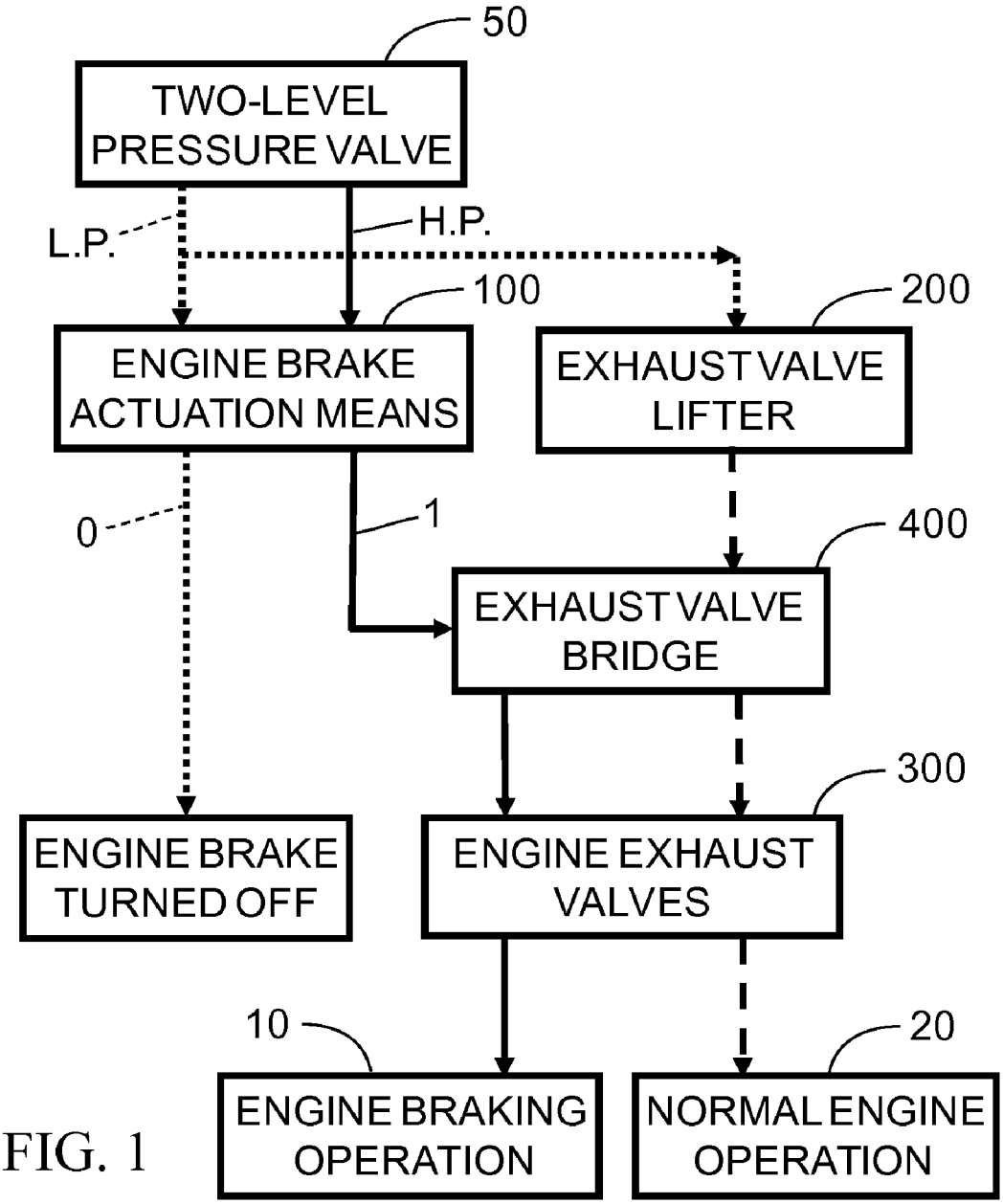
FIG. 1 is a flow chart illustrating the general relationship between a normal engine operation and an added engine braking operation according to one version of the present invention.

FIG. 1 is a flow chart illustrating the general relationship between a normal engine operation 20 and an added engine braking operation 10 according to one version of the present invention. An internal combustion engine contains two exhaust valves 300 and an exhaust valve lifter 200 for cyclically opening and closing the two exhaust valves 300 through a valve bridge 400 during the normal engine operation 20. The engine braking operation 10 is achieved by turning on a flow control valve 50 that is able to supply a control fluid with two levels of pressure, a first level or low level pressure (L.P.) and a second level or high level pressure (H.P.). The second level pressure is high enough to move the engine brake actuation means 100 integrated in the valve bridge 400 from an inoperative position 0 to an operative position 1 to convert the engine from the normal operation 20 to the braking operation 10. By default, the flow control valve 50 is at the off position and the control fluid at the first level or lower pressure is supplied to both the actuation means 100 and the exhaust valve lifter 200 for lubrication purposes. The actuation means 100 will stay at the inoperative position 0 and the engine brake is turned off.

Figure 2A:
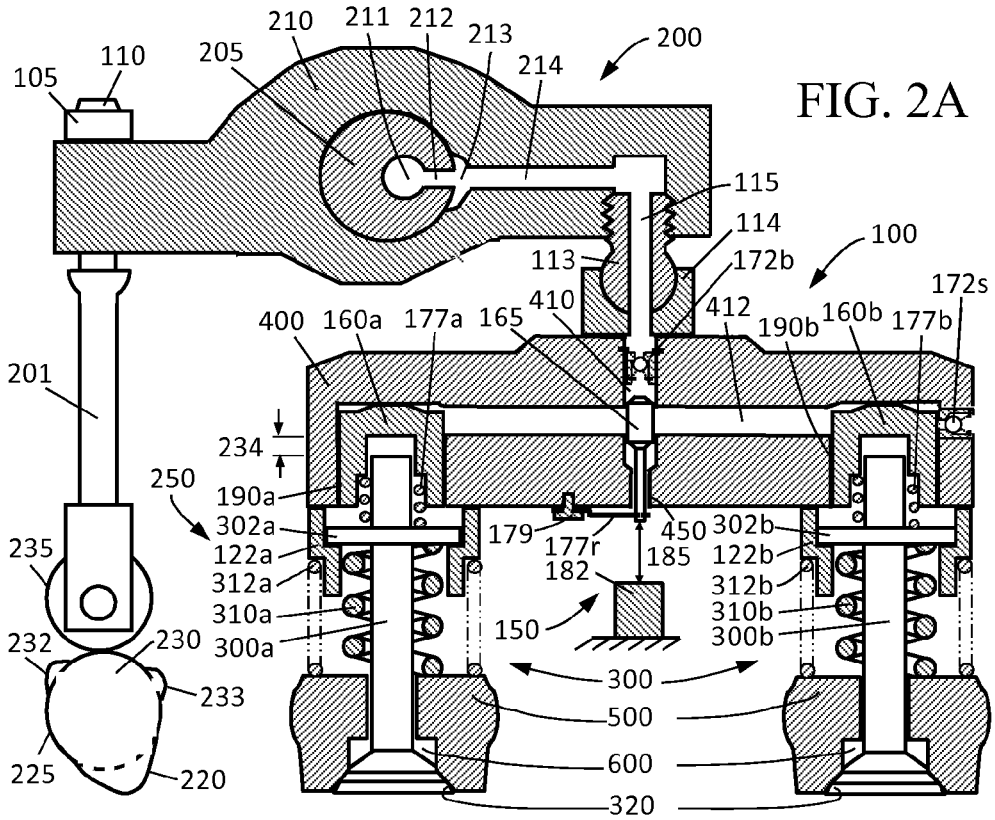
FIGS. 2A and 2B are schematic diagrams of an engine braking apparatus at the "Off" and "On" positions according to a first embodiment of the present invention.
Figure 2B:
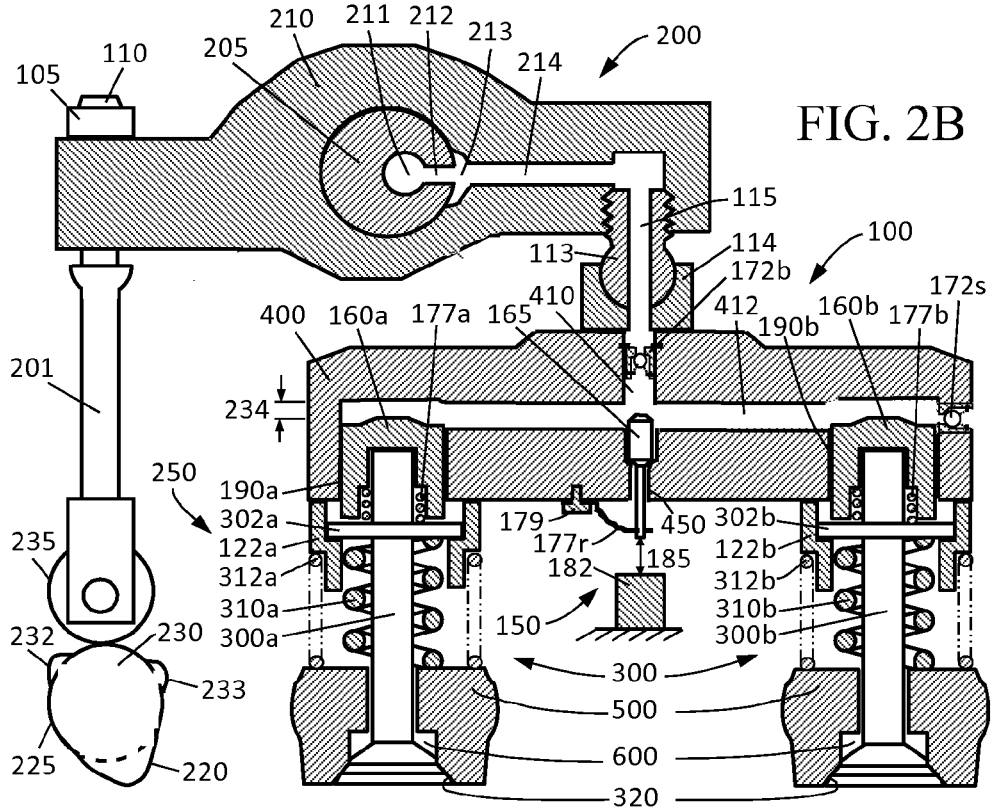

FIGS. 2A and 2B are schematic diagrams of an engine braking apparatus at the "Off" and "On" positions according to a first embodiment of the present invention. There are three sub-systems: the engine brake actuation means 100, an exhaust valve lifter 200 and two exhaust valves 300. A valve bridge 400 is used for opening the two exhaust valves 300 with one rocker arm 210. The exhaust valve lifter 200 and the exhaust valves 300 plus the valve bridge 400 form the so called exhaust valve train. In addition to the above three sub-systems, a two-level pressure flow control valve is used to provide control fluid with the first (lower) level pressure and the second (higher) level pressure to the engine brake actuation means 100. Details of the two-level pressure flow control valve will be described later.

The exhaust valve lifter 200 includes a cam 230, a cam follower 235, a push rod or tube 201, and the rocker arm 210. Usually, there is a valve lash adjusting means either on the push rod side or on the valve bridge side. Here, a lash adjusting screw 110 is in contact with the push rod 201 and secured on the rocker arm 210 by a lock nut 105. The exhaust cam 230 contains an enlarged cam lobe 220 above the inner base circle 225 mainly for the normal engine operation. The enlarged cam lobe 220 is larger than a regular or normal exhaust cam lobe because a small cam lobe 233 is added for the engine braking operation. Another small cam lobe 232 could be added for braking gas recirculation to enhance engine braking performance. The rocker arm 210 can pivot on the rocker shaft 205. The other end of the rocker arm 210 is connected to an elephant foot 114 through a connector 113.

The two valves 300*a* and 300*b* (or simply 300) are biased upwards against their seats 320 on the engine cylinder head 500 by engine valve springs 310*a* and 310*b* (or simply 310) to seal gas (air, during engine braking) from flowing between the engine cylinder and the exhaust manifolds 600. Mechanical input or motion from the exhaust cam 230 is transmitted to the exhaust valves 300 through the exhaust valve lifter 200 and the valve bridge 400 for their cyclical opening and closing.

The engine brake actuation means 100 contains two braking pistons (also known as actuation pistons or hydraulic pistons) 160*a* and 160*b* (or simply 160) slidably disposed in bores 190*a* and 190*b* (or simply 190) in the valve bridge 400 between the inoperative position (FIG. 2A) and the operative position (FIG. 2B). A supporting means 250 is designed to prevent the exhaust valve train from having no-follow. The supporting means 250 contains an engine valve spring, for example, the outer spring 312*a* or 312*b* (or simply 312), and a spring seat 122*a* or 122*b* (or simply 122) that is biased against the valve spring retainer 302*a* or 302*b* (or simply 302) by the outer spring 312. The valve bridge 400 is supported by the two spring seats 122, not by the two exhaust valves 300 as usual (or prior art). Therefore, a gap 234 can be formed between the valve bridge 400 and the exhaust valves 300 to skip the motion from the lower portion of the cam 230, including the small cam lobes 232 and 233, during the normal engine operation.

Instead of being heavily loaded by a special "external" spring designed for preventing no-follow as disclosed by U.S. Patent Pub. No. 2005/0211206, the two braking pistons 160 shown in FIGS. 2A and 2B are not subjected to any load from the springs 312. Instead, springs 177*a* and 177*b* (or simply 177) are dedicated to the engine braking operation, not affected by the moment of inertia or no-follow of the valve train. The braking spring 177*a* or 177*b* is so designed that when the control fluid from the flow control valve 50 is at or below the first level pressure (as low as the ambient pressure), the braking piston 160 will not move from the inoperative position (FIG. 2A) to the operative position (FIG. 2B); but when the control fluid is at or above the second level pressure, the braking piston 160 will move from the inoperative position to the operative position. At the normal engine operation, the braking pistons 160 are biased to the inoperative position as shown in FIG. 2A.

With the supporting means 250, the braking springs 177 are less critical. Actually, by controlling the opening pressure of the check valve 172*b* and the first level pressure of the control fluid, the braking springs 177 may not be needed at all. To the other extreme, the outer engine valve springs 312 may not be needed for supporting the valve bridge 400, then the braking springs 177 may be used for controlling both the no-follow and the engine braking operation. In such a case, the spring seats 122 won't be necessary, but the braking springs 177 need to be stronger and the second level pressure of the control fluid to be higher to actuate the engine brake.

When engine braking in needed, the flow control valve 50 whose function will be explained later is turned on (FIG. 5B) to allow the control fluid with the second level or higher pressure to flow to the braking pistons 160 as shown in FIGS. 2A and 2B through the braking fluid circuit. The braking fluid circuit includes a flow passage 211 and a radial orifice 212 in the rocker shaft 205, a groove or cut 213 and a flow passage 214 in the rocker arm 210, a flow passage 115 in the connector 113 to the elephant foot 114, and flow passages 410 and 412 in the valve bridge 400. A check valve means 172*b* is disposed before the braking pistons 160 in the flow passage 410. Oil pressure at the second level or higher overcomes the load of the braking springs 177 and pushes the braking pistons 160 down and out of the bores 190 to the exhaust valves 300. The braking pistons 160 are at the operative position now and their motion or stroke is limited by the exhaust valves 300 and equal to the gap 234 as shown in FIG. 2B. The control fluid displaced the braking pistons 160 takes up the gap 234 and forms a hydraulic linkage between the valve bridge 400 and the exhaust valves 300. As the cam 230 rotates, the motion from the whole cam including the small braking cam lobes 232 and 233 is transmitted to the exhaust valves 300 through the hydraulic linkage, since the braking pistons 160 are hydraulically locked to the operative position by the check valve means 172*b* and the resetting piston 165 whose function will be explained later.

The engine brake actuation means 100 also includes a safety valve 172*s* installed in the valve bridge 400 and hydraulically connected to the bore 412. It is a pressure relief type check valve and designed to be open only when the fluid pressure over the braking pistons 160 is above a predetermined value so that the related system components will not be overloaded. The predetermined value mainly depends on the load limit of the exhaust valve train and the engine brake actuation means 100.

The engine brake resetting means 150 is designed to modify the valve lift profile produced by the enlarged exhaust cam lobe 220. It includes a drain orifice 450 in the valve bridge 400 and the resetting piston 165 slidably disposed in the valve bridge 400 between a draining position and a feeding position. In the draining position (FIG. 2A), the resetting piston 165 opens the drain orifice 450, blocks the flow passage 410 and drain out the control fluid to let the two braking pistons 160*a* and 160*b* move from the operative position to the inoperative position. In the feeding position (FIG. 2B), the resetting piston 165 closes the drain orifice 450, opens the flow passage 410 and allows the control fluid with the second level or higher pressure to flow to the two braking pistons 160 and move them from the inoperative position to the operative position.

The resetting means 150 also includes a resetting spring 177*r* and a resetting piston stop 182. The resetting spring 177*r* is mounted on the valve bridge 400 by a crew 179 and biases the resetting piston 165 up to the draining position during the normal engine operation as shown in FIG. 2A. The resetting piston stop 182 is on the engine and below the resetting piston 165 with a resetting gap 185. As the cam 230 rotates and the resetting piston 165 moves down with the valve bridge 400 toward the resetting piston stop 182, the resetting gap 185 gets smaller. The resetting gap 185 is so designed that when the resetting piston 165 is at the draining position (FIG. 2A), it will not contact the resetting piston stop 182 during the whole cam rotation or cycle. During the engine braking operation, the control fluid overcomes the preload of the resetting spring 177*r* and pushes the resetting piston 165 from the draining position downward to the feeding position (FIG. 2B). As the enlarged exhaust cam lobe 220 moves the valve bridge 400 and the two exhaust valves 300 down to approach their maximum or peak lift, the resetting piston stop 182 will stop the resetting piston 165 from going downward with the valve bridge 400, which changes the resetting piston 165 from the feeding position to the draining position. The control fluid drains out of the opened drain orifice 450 and the hydraulic linkage between the valve bridge 400 and the two exhaust valves 300 is temporarily lost. The two braking pistons 160 move upward from the operative position to the inoperative position. The lift of the two exhaust valves 300 is reset from the lift profile generated by the enlarged exhaust cam lobe 220 to a predetermined smaller lift profile, for example, the valve lift profile that would be generated by a regular exhaust cam for engines without an engine brake system. The resetting gap 185 can be varied by using an adjustable resetting piston stop 182 to meet the predetermined smaller valve lift profile.

Once the cam rotation passes the peak lift of the enlarged exhaust cam lobe 220, the valve bridge 400 will move upward and the resetting piston 165 in the valve bridge 400 will change from the draining position back to the feeding position. Control fluid with the second level pressure can flow to the braking piston 160*a* and 160*b* again and move them from the inoperative position back to the operative position to form the hydraulic linkage between the valve bridge 400 and the two exhaust valves 300. Therefore, the motion from the lower portion of the cam 230 including the small cam lobes 232 and 233 will be always transmitted to the exhaust valves. Only the motion from the higher portion of the cam 230 will be truncated by the resetting means 150.

Figure 3:
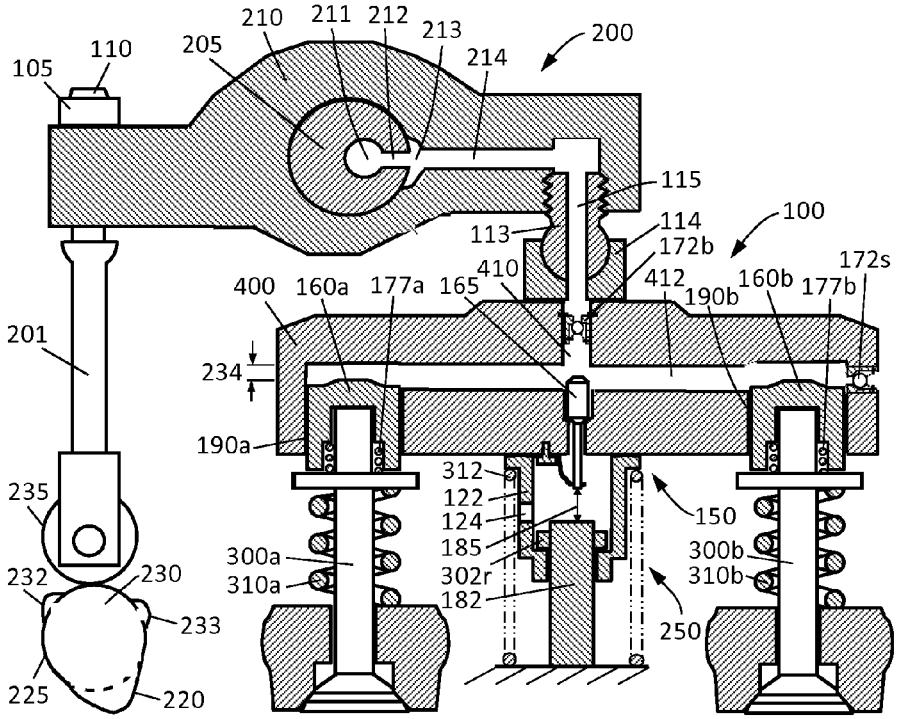
FIG. 3 is a schematic diagram of an engine braking apparatus at the "Off" position according to a second embodiment of the present invention.

FIG. 3 is a schematic diagram of an engine braking apparatus at the "On" position according to a second embodiment of the present invention. The only difference between this embodiment and the first one is the supporting means 250. In this embodiment, the supporting means 250 is located below the valve bridge 400 and between the two exhaust valves 300. The engine valve springs (the outer valve springs) are not utilized here. Instead, a dedicated supporting spring 312 is used to bias the spring seat 122 to a spring retainer 302*r* fixed on the resetting piston stop 182 that is also acting as a guide to the sliding of the spring seat 122. The resetting piston stop 182 can be a screw and the spring retainer 302*r* a lock nut so that the position of the spring seat 122 can be adjusted. There is a hole, or cut, 124 in the spring seat 122 to eliminate any hydraulic lock. The valve bridge 400 is supported by the spring seat 122. The gap 234 between the valve bridge 400 and the two valves 300 is formed, and the two braking pistons 160 are not subjected to any load from the supporting spring 312. The working mechanism and operation of this embodiment are the same as the first embodiment shown in FIGS. 2A and 2B and not explained here for simplicity.

Figure 4A:
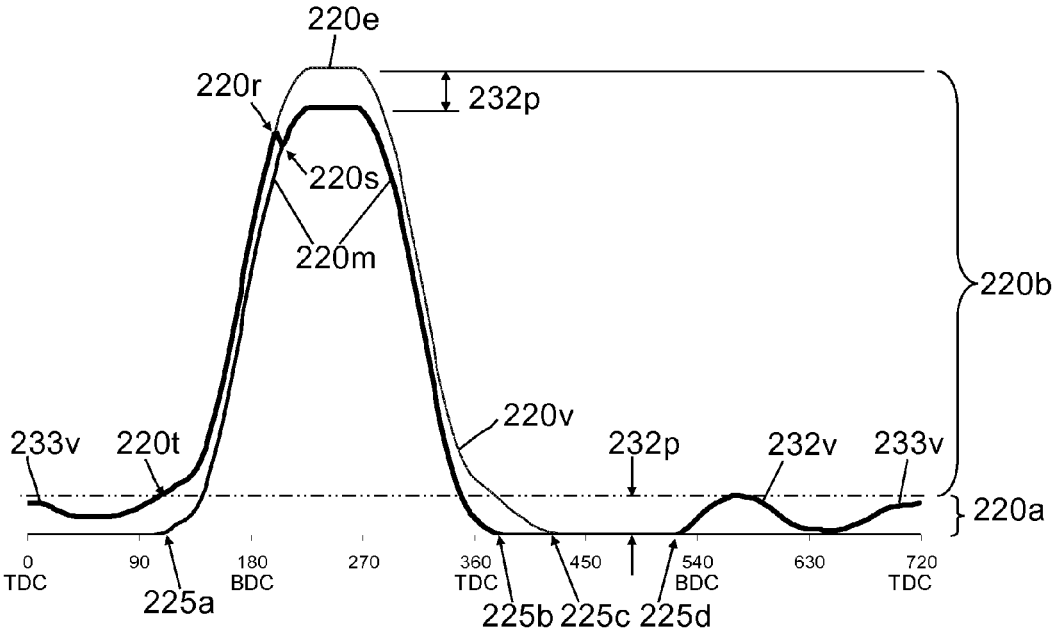
FIGS. 4A, 4B and 4C illustrate the engine exhaust valve lift profiles according to different versions of the present invention.

FIG. 4A shows three different exhaust valve lift profiles to illustrate the engine operation including the engine braking operation with and without valve lift resetting by the resetting means 150. The first valve lift profile is the main valve lift 220*m* for the normal engine operation. The second is the enlarged exhaust valve lift 220*v* plus the secondary or braking valve lifts 232*v* and 233*v* for the engine braking operation when there is no engine brake resetting. The third is a hybrid valve lift profile for the engine braking operation with the engine brake resetting means 150. The valve lift profiles shown in FIG. 4A are for illustrative purposes only, and are not intended to be limiting.

During the normal engine operation, the lower portion of the cam 230, including the small cam lobes 232 and 233, are skipped or lost (cam motion not transmitted to the exhaust valves) due to the gap 234 between the valve bridge 400 and the two valves 300 as shown in FIG. 2A. Shown in FIG. 4A is the transition point 220*t* between the lower portion 220*a* and the higher portion 220*b* of the enlarged exhaust valve lift profile 220*v* from the cam 230. The height 232*p* of the lower portion 220*a* is equal to or slightly larger than the peak valve lifts 232*v* and 233*v* from the two small cam lobes 232 and 233. All the valve lifts below the transition line passing the transition point 220*t* are skipped or lost to produce the first or main valve lift profile 220*m* starting at point 225*a* and ending at point 225*b* with a peak lift of 220*b*.

During the engine braking operation, the braking pistons 160 are moved down from the inoperative position (FIG. 2A) to the operative position (FIG. 2B) by the control fluid with the second level or higher pressure. The gap 234 between the valve bridge 400 and the two valves 300 is taken up by the control fluid and a hydraulic linkage is formed. The motion from the whole cam 230 can be transmitted to the exhaust valves 300. However, the valve lift profile will be different with the resetting means 150 than without it. If there is an engine brake resetting means 150 as shown in FIGS. 2A and 2B, then the valve lift profile will change when the valve lift hits the reset point 220*r* (FIG. 4A). The valve lift will drop back from the reset point 220*r* on the enlarged exhaust valve lift profile 220*v* (the second valve lift profile) to the point 220*s* on the main valve lift profile 220*m* (the first valve lift profile), and finally end at point 225*b*, much earlier than the point 225*c*. Therefore, the hybrid valve lift profile includes the engine braking valve lifts 232*v* and 233*v* as well as the truncated enlarged exhaust valve lift as shown by the thick solid line in FIG. 4A. Theoretically, the reset point 220*r* (where the resetting piston 165 hits the resetting piston stop 182 as shown in FIG. 2B) can be anywhere between the transition point 220*t* and the maximum enlarged valve lift 220*e*. But making the reset point 220*r* closer to the maximum enlarged valve lift 220*e* reduces oil consumption and the resetting piston travel.

The engine brake resetting means 150 shown in FIGS. 2A and 2B eliminates the drawbacks of those disclosed by the prior art, for example, U.S. Patent Pub. No. 20050211206. First, the engine brake will never have a false start during the normal engine operation even with no-follow, engine valve floating, excess oil leakage or other abnormal conditions because the resetting piston 165 is biased up to the draining position as shown in FIG. 2A. Second, the resetting piston 165 will not contact or impact the resetting piston stop 182 during the normal engine operation, which reduces its duty cycle by more than 90% because less than 10% of the engine cycles are for the braking operation. Third, the resetting does not happen during the engine braking lift 233*v*, but during the higher portion 220*b* of the enlarged exhaust valve lift 220*v* as shown in FIG. 4A. There is no high oil pressure or large load acting on the resetting piston 165. Therefore, the resetting means 150 disclosed here is more reliable, more tolerant to variation and easier to design and manufacture.

Figure 4B:
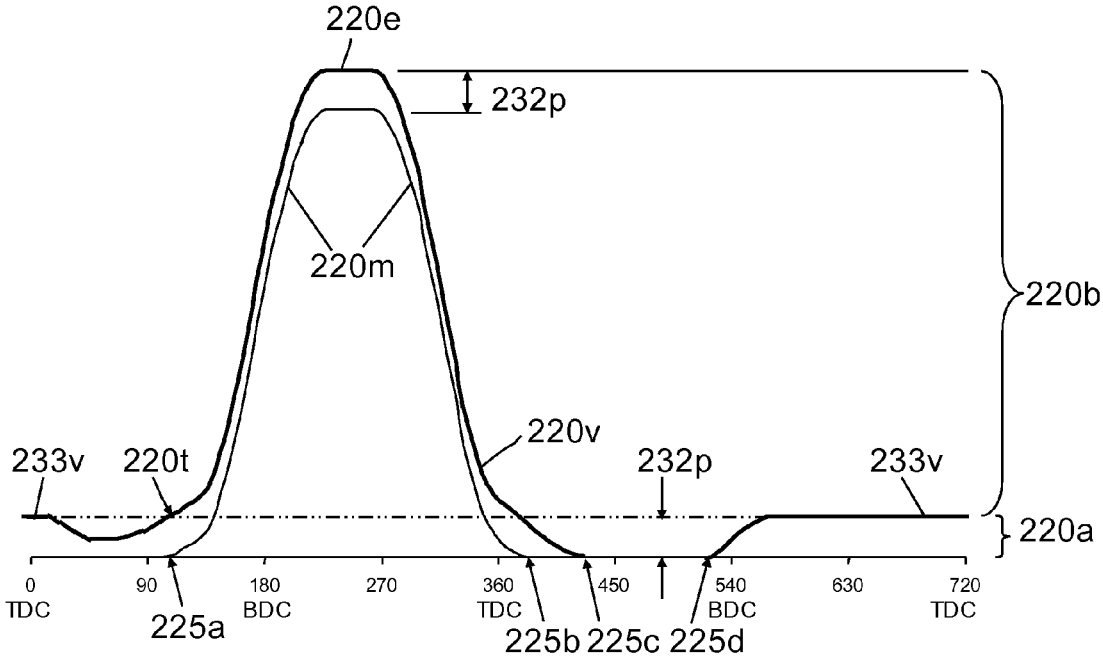
Figure 4C:
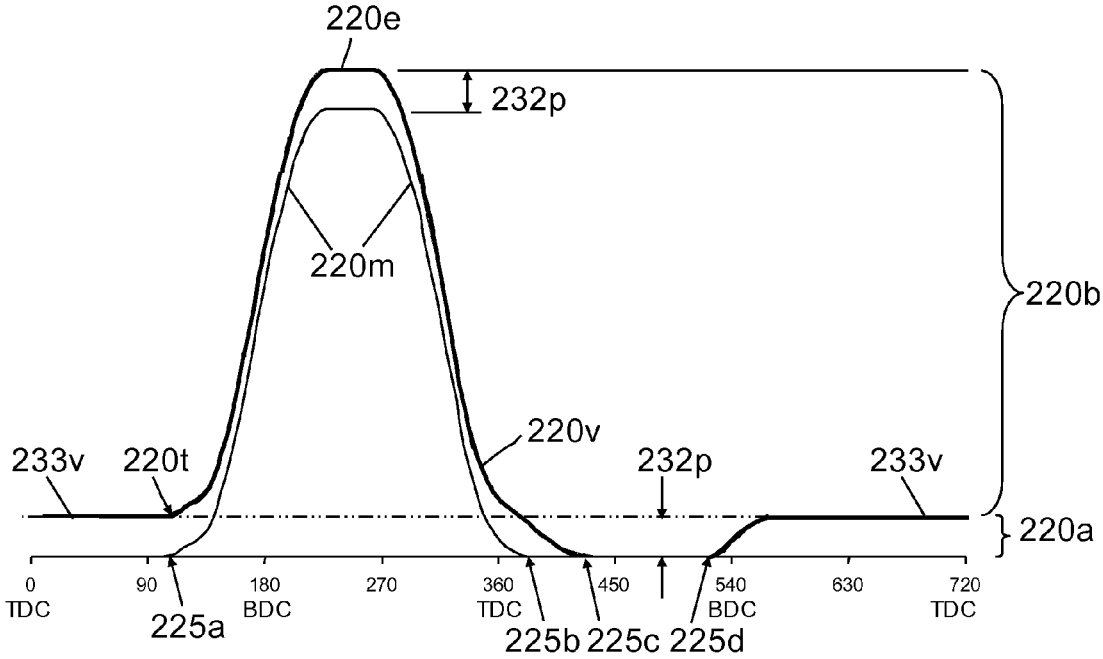

The valve lift profiles illustrated in FIG. 4A could be different. The braking gas recirculation (BGR) lift 232*v* and the CREB lift 233*v* could be separated individual bumps or connected to each other to form a single valve lift bump 233*v* from a single cam lobe as shown in FIG. 4B for a partial cycle bleeder brake, which has a substantially constant valve lift throughout the compression stroke and no valve lift during most of the intake stroke. The single cam lobe can even be extended to the enlarged cam lobe 220. Now the "single" cam lobe is in fact just a transition "step" to the large cam lobe 220 and form yet another valve lift profile as shown in FIG. 4C. In summary, the cam 230 contains at least one small lobe that includes the constant lift type shown in FIGS. 4B and 4C for a partial cycle bleeder brake.

Figure 5A:
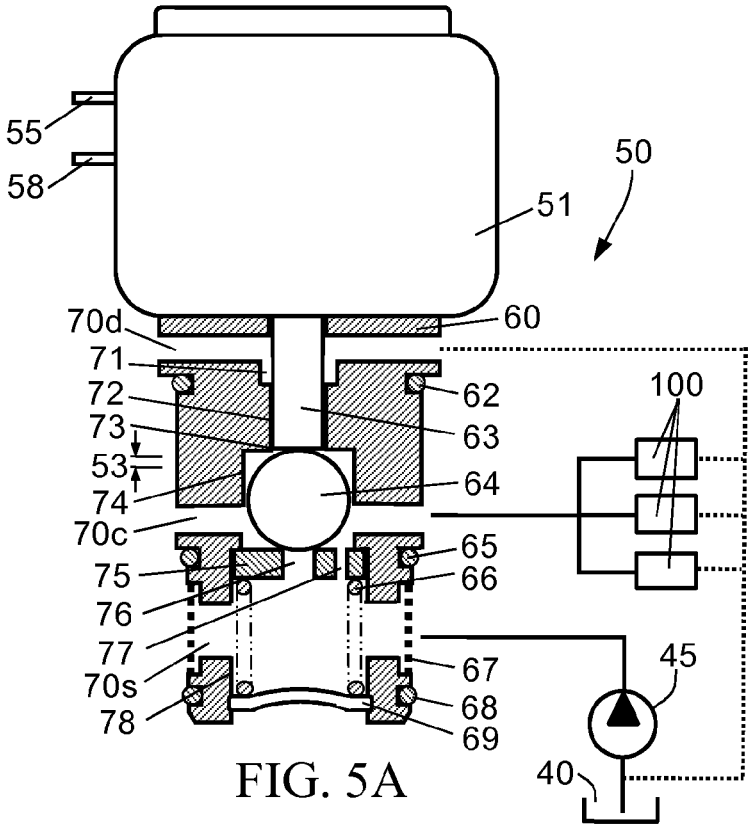
FIGS. 5A and 5B are schematic diagrams of a flow control valve at the "Off" position and the "On" position according to one version of the present invention.
Figure 5B:
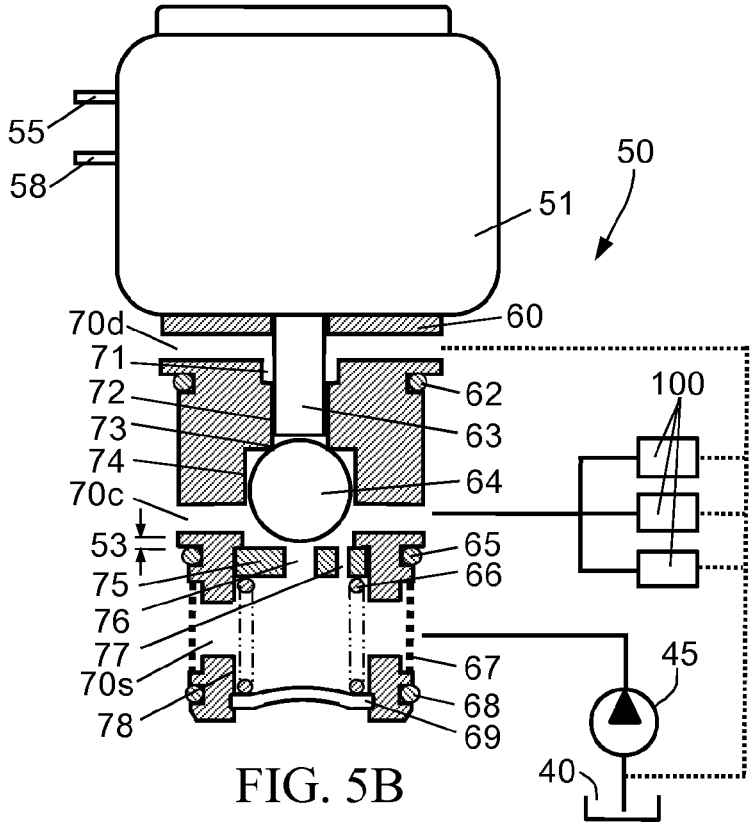

FIGS. 5A and 5B are schematic diagrams of the flow control valve 50 at the "Off" position and the "On" position according to one version of the present invention. It has a coil structure 51 on top of the valve and a valve body 60 attached to the coil structure. The coil structure is well known and its details are not shown here for simplicity. However, one specification of the coil structure needed here is that the electromagnetic force is upward when the electric current to the terminals 55 and 58 is turned on.

The valve body 60 has a first bore 78 in communication with an inlet port 70*s*, a second bore 74 in communication with an outlet port 70*c* and a third bore 72 in communication with a drain port 70*d* adjacent to the coil structure 51. A disc 75 is mounted in the first bore 78 and separates the inlet port 70*s* and the outlet port 70*c*. The disc 75 contains a central orifice 76 and is forced by a spring 66 to the shoulder formed between the first bore 78 and the second bore 74. A movable valve member, for example, a ball 64 is disposed in the second bore 74 and between the disc 75 and a valve seat 73 formed by the interface of the second bore 74 and the third bore 72. A plunger 63 is slidably disposed in the third bore 72, whose motion is controlled by the electromagnetic force from the coil structure 51. The plunger 63 biases the ball 64 away from the seat 73 but against the disc 75 to seal the central orifice 76 against the supply pressure of the control fluid from the inlet port 70*s* when the flow control valve is at the "Off" position (FIG. 5A). The three ports are separated or sealed from each other by O-rings 62 and 65. An O-ring 68 is used to prevent the control fluid from getting to the bottom of the valve. A screen 67 can be installed before the inlet port 70*s* to prevent any contaminants from getting into the valve.

There are other special features or advantages of the flow control valve 50 which are desirable to the engine braking operation:

(a) The bottom end of the first bore 78 is blocked or sealed by a spring seat 69 and the control fluid is supplied form the pump 45 to the inlet port 70*s* on the side of the valve, which greatly reduces the up-lift force by fluid pressure on the valve as well as the clamping force and the size of the valve.

(b) The upper half of the ball 64 is contained or enclosed in the second bore 74 while its lower half exposed to the outlet port 70*c*, which will increases the opening pressure by the control fluid or reduce the retaining force by the plunger 63 on the ball 64.

(c) An off-center orifice 77 may be added into the disc 75 in addition to the central orifice 76. The off-center orifice 77 is much smaller than the central orifice 76 and constantly in communication with the inlet port 70*s* and the outlet port 70*c* even the flow control valve is at the "Off" position as shown in FIG. 5A so that the control fluid with a lower level (the first level or lower) pressure can be supplied to the engine brake actuation means 100 for lubrication purposes. When the flow control valve 50 is turned on, the plunger 63 will move up and so is the ball 64 as shown in FIG. 5B. Both the central orifice 76 and the off-center orifice 77 will be open and the control fluid with a much higher level (the second level or higher) pressure is supplied to the engine brake actuation means 100 for the engine braking operation.

(d) A pressure relief means is designed for preventing the control fluid from leaking from the valve body 60 to the coil structure 51. The pressure relief means includes a 360° annular gap 71 around the plunger 63 so that the fluid pressure at the intersection of the third bore 72 and the drain port 70*d* approaches to the ambient (draining) pressure and no fluid can leak into the coil structure 51, but flow back to a fluid reservoir or tank 40.

(e) The radial clearance between the third bore 72 and the plunger 63 can vary to meet different requirements. When the clearance is small as shown in FIGS. 5A and 5B, flow from the outlet port 70*c* to the drain port 70*d* is blocked and a two-way solenoid valve is formed, which is desirable for the operation of engine braking systems with resetting means 150, such as the embodiment shown in FIGS. 2A and 2B.

Figure 6A:
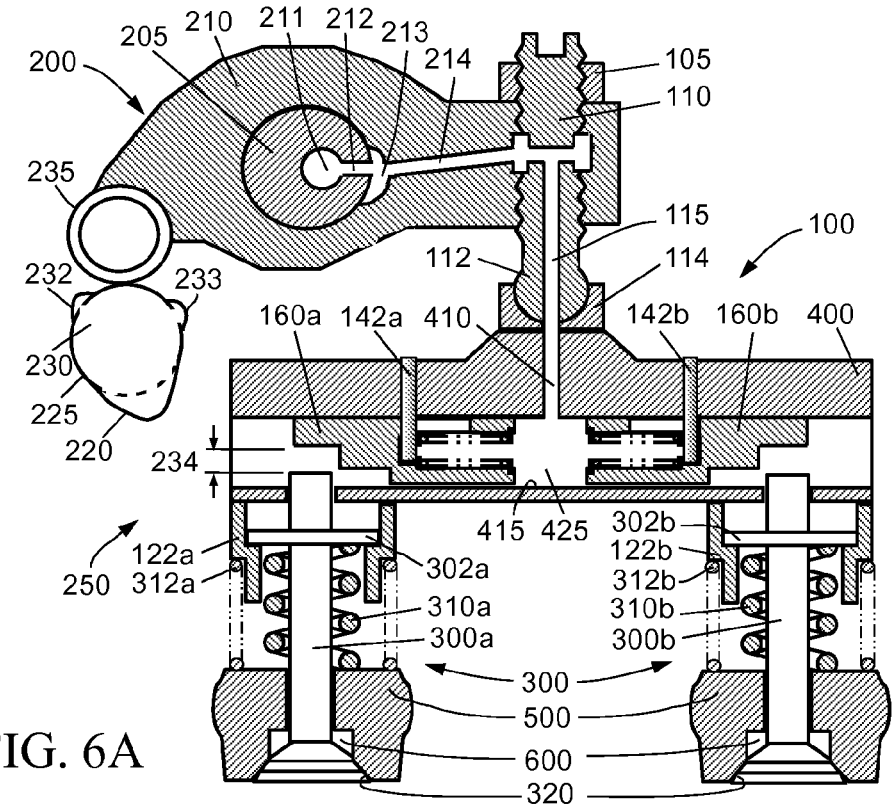
FIGS. 6A and 6B are schematic diagrams of an engine braking apparatus at the "Off" and "On" positions according to a third embodiment of the present invention.
Figure 6B:
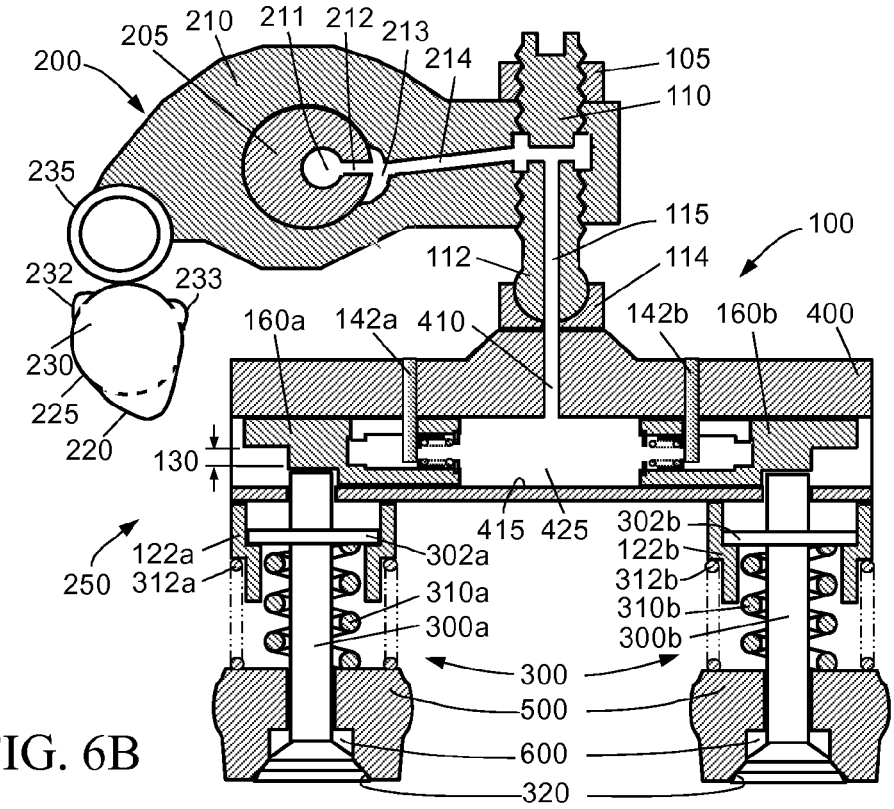

FIGS. 6A and 6B are schematic diagrams of an engine braking apparatus at the "Off" and "On" positions according to a third embodiment of the present invention. The engine is an overhead cam engine. Therefore, the valve lash adjusting system is moved to the valve bridge side. There is a flow passage 115 in the valve lash adjusting screw 110. The elephant foot 114 is attached to the lower part 112 of the screw, while the upper part of the screw 110 is tightened to the rocker arm 210 by the lock nut 105. Note that the embodiment presented here can also be applied to a push rod/tube engine.

Figure 6C:
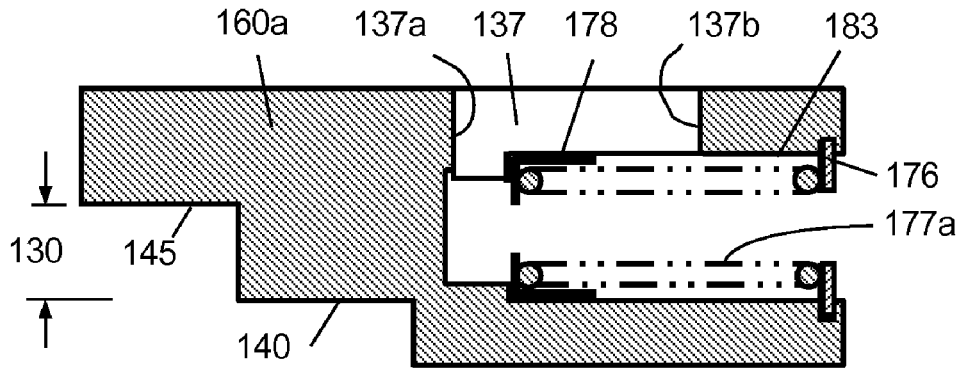
FIG. 6C is a detailed view of the braking piston assembly contained in the engine braking apparatus as shown in FIGS. 6A and 6B.

The two braking pistons 160*a* and 160*b* (or simply 160) with details in FIG. 6C are slidably disposed in a bore 415 in the valve bridge 400. The braking pistons 160 contain a first surface 140 commensurate with the operative position and a second surface 145 commensurate with the inoperative position. The two surfaces are on two flat cuts on the braking pistons 160 and have a height difference 130 (FIG. 6C). The braking pistons 160 are biased to the inoperative position by the braking springs 177*a* and 177*b* (or simply 177) to form a gap 234 between the valve bridge 400 and the exhaust valves 300 as shown in FIG. 6A. The gap 234 is equaled to slightly larger than the height difference 130. One end of the braking spring 177*a* sits on a spring seat 176 that is mounted on the braking piston 160*a*. The other end of the spring 177*a* sits on another spring seat 178 slidable disposed in a bore 183. The spring seat 178 shown in FIG. 6C is stopped at the end of the bore 183. But when the braking pistons 160 are assembled in the valve bridge 400, the spring seat 178 is normally stopped by pins 142*a* and 142*b* (or simply 142) fixed in the valve bridge 400 as shown in FIGS. 6A and 6B. There is a slot 137 or axial cut across the bore 183 (FIG. 6C) in the braking pistons 160, which has a width slightly larger than the pins 142. The pin 142*a* and the slot 137 with the two end surfaces 137*a* and 137*b* form a motion limiting means to control the movement of the braking piston 160*a* between the inoperative position and the operative position. They also form an anti-rotation means to the braking pistons 160 so that the first and second surface 140 and 145 always face down toward the exhaust valves 300.

When engine braking is needed, the flow control valve 50 is turned on (FIG. 7B, detailed explanation of valve 50 to follow) to allow the control fluid with the second level or higher pressure to flow through the engine braking fluid circuit and into a pressure chamber 425 in the valve bridge 400 (FIG. 6A). The fluid pressure overcomes the preload of the braking springs 177 and pushes the braking pistons 160 toward the exhaust valves 300. When the end surface 137*b* of the slot 137 (FIG. 6C) hits the pin 142*a* (FIG. 6B), the braking piston 160*a* is moved from the inoperative position the operative position with the operative surface 140 (FIG. 6C) over the valve 300*a* (FIG. 6B). The gap 234 between the valve bridge 400 and the two valves 300 (FIG. 6A) is taken up (eliminated or greatly reduced) and a linkage is formed (FIG. 6B). As the cam 230 rotates, the motion from the whole cam 230 is transmitted to the exhaust valves 300 to generate the second valve lift profile 220*v* as shown in FIG. 4A. The second valve lift profile 220*v* starts at point 225*d* with zero valve lift, goes over the BGR bump 232*v*, is followed by the CREB bump 233*v*, then passes the transition point 220*t* between the lower portion 220*a* and the higher portion 220*b*, moves up to the reset point 220*r* (but no resetting) and over the peak 220*e* of the enlarged main valve lift, finally ends at point 225*c* with zero valve lift. Note that the lower portion 220*a* of the enlarged exhaust valve lift profile 220*v* has approximately the same height as the secondary valve lift profile 232*v* or 233*v*, and the higher portion 220*b* has approximately the same height and duration as the main valve lift profile 220*m*.

Figure 7A:
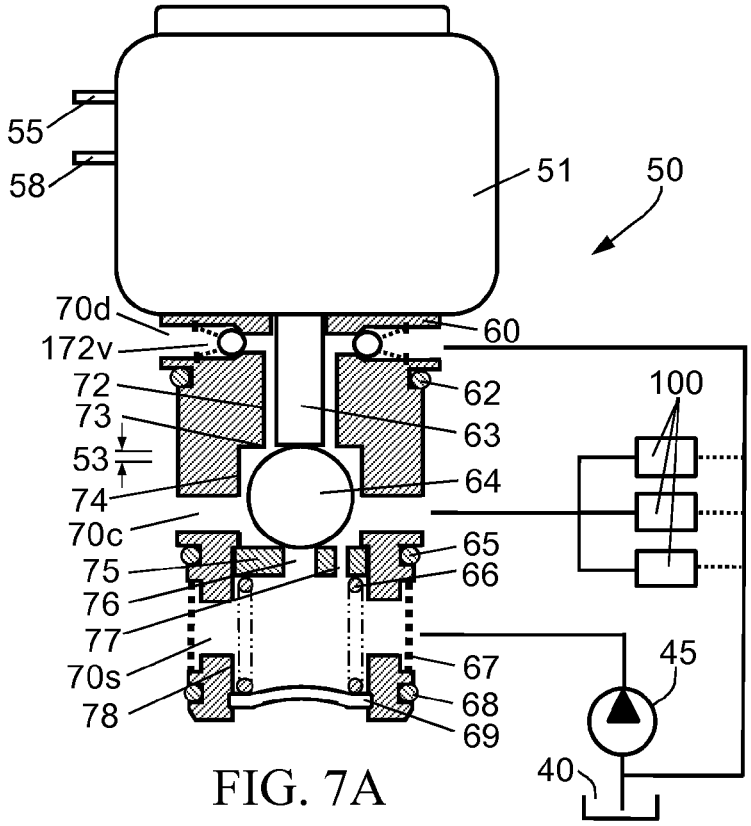
FIGS. 7A and 7B are schematic diagrams of a flow control valve at the "Off" position and the "On" position according to another version of the present invention.

When engine braking is not needed, the flow control valve 50 is turned off as shown in FIG. 7A and the control fluid will drain out of the braking fluid circuit. The pressure in the chamber 425 in the valve bridge 400 (FIG. 6A) will drop from the second level or higher to the first level or lower. The braking pistons 160 will be pushed back into the valve bridge 400 by the braking springs 177. Once the inoperative surface 145 (FIG. 6C) is over the exhaust valves 300 as shown in FIG. 6A, the braking pistons 160 are at the inoperative position and the gap 234 is formed to skip the motion from the lower portion of the cam 230, including the small braking cam lobes 232 and 233 to generate the first valve lift profile 220*m* as shown in FIG. 4A for the normal engine operation. The valve lift profiles shown in FIGS. 4B and 4C can also be achieved by the braking apparatus disclosed here.

Figure 6D:
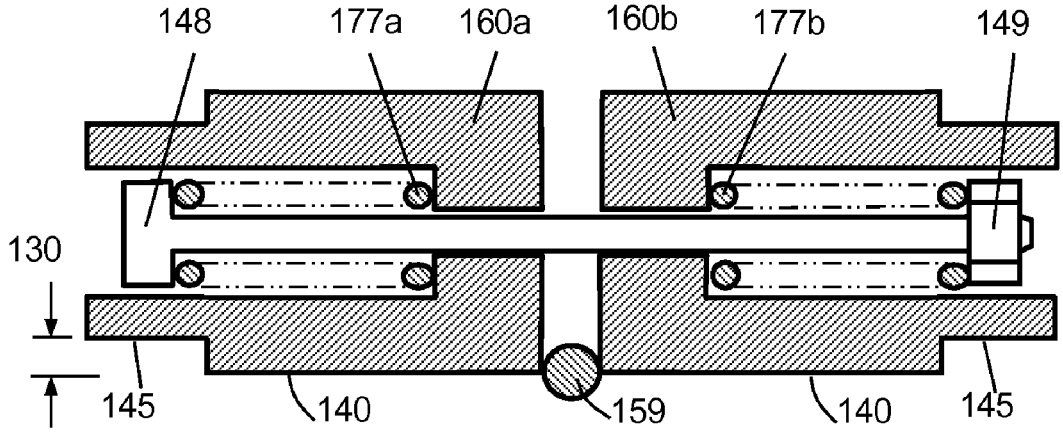
FIG. 6D is a detailed view of another braking piston assembly that could be used in the engine braking apparatus as shown in FIGS. 6A and 6B.

FIG. 6D shows a different braking piston assembly that can be used for the embodiment shown in FIGS. 6A and 6B. The two braking pistons 160*a* and 160*b* are biased toward each other by the braking springs 177*a* and 177*b* that are held and guided by a screw 148 and a screw nut 149. The inoperative surface 145 and the operative surface 140 are cylindrical. When assembled in the valve bridge 400, the two braking pistons 160*a* and 160*b* are separated by a clip ring 159 (FIG. 6D) that can be mounted in a groove (not shown) at the center of the bore 415 (FIGS. 6A and 6B).

Figure 7B:
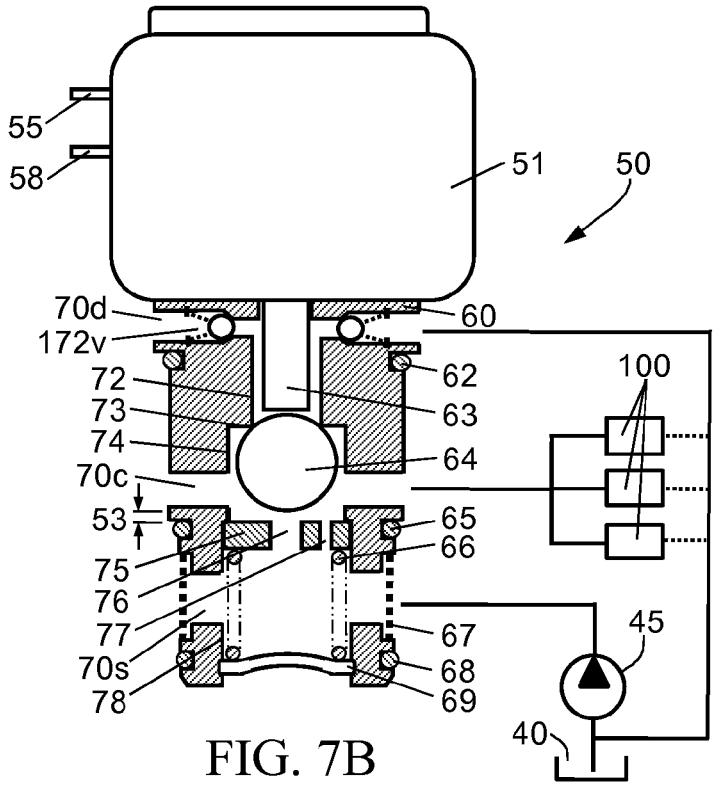

FIGS. 7A and 7B are schematic diagrams of the flow control valve 50 at the "Off" position and the "On" position according to another version of the present invention. There are two major differences between the embodiment shown here and that shown in FIGS. 5A and 5B. First, the radial clearance between the third bore 72 and the plunger 63 is increased to form a flow passage between the outlet port 70*c* and the drain port 70*d*, and a three-way solenoid valve is formed, which is more suitable to the engine brake systems without resetting means, such as the embodiment shown in FIGS. 6A and 6B. Second, a pressure control means 172*v* is added into the drain port 70*d* to keep the control fluid to the engine brake actuation means 100 at the first level pressure when the flow control valve 50 is at the "Off" position as shown in FIG. 7A.

When the flow control valve 50 is turned to the "On" position as shown in FIG. 7B, the plunger 63 is moved up due to the upward electromagnetic force of the coil structure 51. Once the plunger 63 is out of the way, the ball 64 is pushed up against the seat 73 by the pressure of the control fluid out of the central orifice 76 in the disc 75. The flow passage between the outlet port 70*c* and the drain port 70*d* is blocked and the control fluid at the second level or higher pressure is supplied to the engine brake actuation means 100. Note that the first level pressure is always lower than the second level pressure. The lowest value for the first level pressure is the ambient pressure, while the highest value for the second level pressure is normally below 100 psi and highly dependent on the engine operation conditions, such as the oil temperature, the engine speed, and the oil pump 45.

Conclusion, Ramifications, and Scope

It is clear from the above description that the engine braking apparatus according to the embodiments of the present invention have one or more of the following advantages over the prior art engine braking systems.

First, the systems disclosed here do not increase the engine's weight, height, or moment of inertia. Therefore, the tendency for the valve train to have no-follow is reduced.

Second, the systems disclosed here do not use one special "external" spring to control both the no-follow issues and the engine braking operation. Therefore, the braking pistons do not share the high spring force used to control the no-follow, and the engine brake systems can be fully actuated at all engine speeds. Moreover, there is no need for the extra space to mount the special "external" spring.

Third, the resetting means disclosed here eliminates any potential of false start of the engine brake during the normal engine operation even with no-follow, valve floating, excess oil leakage, or other abnormal conditions. Also, the resetting piston will not contact or impact the resetting piston stop during the normal engine operation, and the resetting only happens when the valves approach their peak lift. Therefore, the resetting means disclosed here is more reliable, more tolerant to variation and easier to design and manufacture.

Fourth, the flow control valves disclosed here have two levels of supply pressure to the engine brake actuation means. They also have other advantages, such as leakage free, low valve clamping force and actuation force, compact size, and orientation free for installation.

While my above description contains many specificities, these should not be construed as limitations on the scope of the invention, but rather as an exemplification of the preferred embodiments thereof. Many other variations are possible. For example, other types of two-way or three way flow control valves can be used for supplying the control fluid to the engine brake actuation means 100 disclosed here. The pressure control means 172*v* of the flow control valve 50 shown in FIGS. 6A and 6B can be an orifice or totally eliminated. The off-center orifice 77 in the disc 75 can also be eliminated to create a standard two-way or three-way solenoid valve, and the first-level pressure could be the ambient pressure. The disc 75 can be supported by other means, such as a press-fit means or a clip ring means, instead of the spring means with the spring 66 and the spring seat 69. A bleeding orifice could be added in the braking pistons 160 of the first and second embodiments for lubrication purposes, or in the braking fluid circuit of the third embodiment for turning off the engine brake quicker or replacing the 3-way solenoid valve with a 2-way solenoid valve.

Also, the apparatus disclosed here can be applied to both push tube type engines and overhead cam engines. The two braking pistons could be replaced by one braking piston. And instead of using two exhaust valves for engine braking, one exhaust valve could be used.

Also, the apparatus disclosed here can be applied to other engine valve train with different engine valve system and engine valve lifter, such as the intake valve system and the intake valve lifter.

Also, the apparatus disclosed here can be used to produce other auxiliary valve event, such as an EGR (exhaust gas recirculation) event, or an early intake valve closing event, etc.

Accordingly, the scope of the invention should be determined not by the embodiments illustrated, but by the appended claims and their legal equivalents.

I claim:

1. Apparatus for converting an internal combustion engine from a normal engine operation to an engine braking operation, the engine having an exhaust valve train comprising two valves, a valve bridge and a cam for cyclically opening and closing the two valves, said apparatus comprising:

(a) an actuator comprising two braking pistons slidably disposed in said valve bridge between an inoperative position and an operative position; in said inoperative position, a gap being formed between said valve bridge and each of the two valves for skipping the motion from the lower portion of the cam, and in said operative position, a linkage being formed between said valve bridge and each of the two valves so that the motion from the whole cam can be transmitted to the two valves;

(b) a flow control valve for supplying control fluid with two levels of pressure to said actuator, said two levels of pressure comprising a first level pressure and a second level pressure, and said first level pressure being lower than said second level pressure; and a supporting mechanism for preventing said exhaust valve train from having no-follow, said supporting mechanism comprising a supporting spring and a spring seat; said supporting spring biasing said spring seat to a spring retainer so that the two braking pistons are not loaded by said supporting spring, and said spring seat holding said valve bridge so that said gap can be formed between said valve bridge and the two valves.

2. Apparatus for converting an internal combustion engine from a normal engine operation to an engine braking operation, the engine having an exhaust valve train comprising two valves, a valve bridge and a cam for cyclically opening and closing the two valves, said apparatus comprising:

(a) an actuator comprising two braking pistons slidably disposed in said valve bridge between an inoperative position and an operative position; in said inoperative position, a gap being formed between said valve bridge and each of the two valves for skipping the motion from the lower portion of the cam, and in said operative position, a linkage being formed between said valve bridge and each of the two valves so that the motion from the whole cam can be transmitted to the two valves; and (b) a flow control valve for supplying control fluid with two levels of pressure to said actuator, said two levels of pressure comprising a first level pressure and a second level pressure, and said first level pressure being lower than said second level pressure, wherein said actuator further comprises a braking spring for biasing each of the two braking pistons to said inoperative position, said braking spring having a preload, and said preload being so designed that: (a) the two braking pistons will not move from said inoperative position to said operative position when the control fluid from said flow control valve is at or below the first level pressure; and (b) the two braking pistons will move from said inoperative position to said operative position when the control fluid from said flow control valve is at or above the second level pressure.

3. Apparatus for converting an internal combustion engine from a normal engine operation to an engine braking operation, the engine having an exhaust valve train comprising two valves, a valve bridge and a cam for cyclically opening and closing the two valves, said apparatus comprising:

(a) an actuator comprising two braking pistons slidably disposed in said valve bridge between an inoperative position and an operative position; in said inoperative position, a gap being formed between said valve bridge and each of the two valves for skipping the motion from the lower portion of the cam, and in said operative position, a linkage being formed between said valve bridge and each of the two valves so that the motion from the whole cam can be transmitted to the two valves; and (b) a flow control valve for supplying control fluid with two levels of pressure to said actuator, said two levels of pressure comprising a first level pressure and a second level pressure, and said first level pressure being lower than said second level pressure, wherein said actuator further comprises a motion limiting mechanism for controlling the movement of the two braking pistons between said inoperative position and said operative position in said valve bridge.

4. Apparatus for converting an internal combustion engine from a normal engine operation to an engine braking operation, the engine having an exhaust valve train comprising two valves, a valve bridge and a cam for cyclically opening and closing the two valves, said apparatus comprising:

(a) an actuator comprising two braking pistons slidably disposed in said valve bridge between an inoperative position and an operative position; in said inoperative position, a gap being formed between said valve bridge and each of the two valves for skipping the motion from the lower portion of the cam, and in said operative position, a linkage being formed between said valve bridge and each of the two valves so that the motion from the whole cam can be transmitted to the two valves; and (b) a flow control valve for supplying control fluid with two levels of pressure to said actuator, said two levels of pressure comprising a first level pressure and a second level pressure, and said first level pressure being lower than said second level pressure, wherein said actuator further comprises a safety valve installed in said valve bridge, said safety valve being open only when the pressure of the control fluid over the two braking pistons is above a predetermined value.

5. A method of modifying engine valve lift in an internal combustion engine, the engine having an engine valve train comprising two valves, a valve bridge and a cam for cyclically opening and closing the two valves, said method comprising the steps of:

(a) providing an actuator comprising two actuation pistons slidably disposed in said valve bridge between an inoperative position and an operative position; in said inoperative position, a gap being formed between said valve bridge and each of the two valves, and in said operative position, a linkage being formed between said valve bridge and each of the two valves;

(b) providing a flow control valve for supplying control fluid with two levels of pressure to said an actuator, said two levels of pressure comprising a first level pressure and a second level pressure, and said first level pressure being lower than said second level pressure;

(c) turning on said flow control valve and supplying the control fluid at the second level or higher pressure to said actuation pistons;

(d) moving said actuation pistons from said inoperative position to said operative position, taking up the gap and forming the linkage between said valve bridge and each of the two valves;

(e) imparting the motion from the whole cam to the two valves;

(f) turning off said flow control valve and reducing the pressure of the control fluid over said actuation pistons to the first level or lower;

(g) moving said actuation pistons from said operative position to said inoperative position and forming the gap between said valve bridge and each of the two valves; and (h) skipping the motion from the lower portion of the cam, while imparting the motion from the higher portion of the cam to the two valves.

6. A method of modifying engine valve lift in an internal combustion engine, the engine having an engine valve train comprising two valves, a valve bridge and a cam for cyclically opening and closing the two valves, said method comprising the steps of:

(a) providing an actuator comprising two actuation pistons slidably disposed in said valve bridge between an inoperative position and an operative position; in said inoperative position, a gap being formed between said valve bridge and each of the two valves, and in said operative position, a linkage being formed between said valve bridge and each of the two valves;

(b) providing a flow control valve for supplying control fluid with two levels of pressure to said an actuator, said two levels of pressure comprising a first level pressure and a second level pressure, and said first level pressure being lower than said second level pressure;

(c) turning on said flow control valve and supplying the control fluid at the second level or higher pressure to said actuation pistons;

(d) moving said actuation pistons from said inoperative position to said operative position, taking up the gap and forming the linkage between said valve bridge and each of the two valves;

(e) imparting the motion from the whole cam to the two valves;

(f) providing a resetting mechanism, said resetting mechanism comprising a drain orifice in said valve bridge, a resetting piston slidably disposed in said valve bridge between a draining position and a feeding position, and a resetting piston stop below said resetting piston;

(g) turning on said flow control valve and supplying the control fluid at the second level or higher pressure to said resetting piston;

(h) pushing said resetting piston to said feeding position by the control fluid and closing said draining orifice;

(i) moving said actuation pistons from said inoperative position to said operative position by the control fluid;

(j) moving said valve bridge down and opening the two valves by the cam;

(k) stopping the downward motion of said resetting piston in said valve bridge by said resetting piston stop while said valve bridge and the two valves continue moving down to their peak lift;

(l) changing the position of said resetting piston in said valve bridge from said feeding position to said draining position and opening said drain orifice to drain out the control fluid above said actuation pistons;

(m) moving said actuation pistons from said operative position to said inoperative position; and (n) resetting the two valves from the lift profile produced by the cam to a predetermined smaller lift profile.

7. Apparatus for converting an internal combustion engine from a normal engine operation to an engine braking operation, the engine having an exhaust valve train comprising two valves, a valve bridge and a cam for cyclically opening and closing the two valves, said apparatus comprising:

(a) an actuator comprising two braking pistons slidably disposed in said valve bridge between an inoperative position and an operative position; in said inoperative position, a gap being formed between said valve bridge and each of the two valves for skipping the motion from the lower portion of the cam, and in said operative position, a linkage being formed between said valve bridge and each of the two valves so that the motion from the whole cam can be transmitted to the two valves;

(b) a flow control valve for supplying control fluid with two levels of pressure to said actuator, said two levels of pressure comprising a first level pressure and a second level pressure, and said first level pressure being lower than said second level pressure; and a resetting mechanism for modifying the valve lift profile produced by said cam, said resetting mechanism comprising a drain orifice and a resetting piston, said resetting piston being movable in said valve bridge between a feeding position and a draining position; in said feeding position, said resetting piston closing the drain orifice and allowing the control fluid to move the two braking pistons from said inoperative position to said operative position, and in said draining position, said resetting piston opening the drain orifice and draining out the control fluid to let the two braking pistons move from said operative position to said inoperative position.

8. The apparatus of claim 7 wherein said engine brake resetting mechanism further comprises a resetting spring for biasing said resetting piston up to the draining position.

9. The apparatus of claim 7 wherein said engine brake resetting mechanism further comprises a resetting piston stop on said engine and below said resetting piston, said resetting piston stop changing the position of said resetting piston in said valve bridge from said feeding position to said draining position by stopping the downward motion of said resetting piston when said valve bridge and the two valves approach their peak lift.

10. The apparatus of claim 9 wherein said resetting piston and resetting piston stop separate from each other by a resetting gap, said resetting gap being adjustable by varying the position or height of said resetting piston stop.

11. Apparatus for converting an internal combustion engine from a normal engine operation to an engine braking operation, the engine having an exhaust valve train comprising two valves, a valve bridge and a cam for cyclically opening and closing the two valves, said apparatus comprising:

(a) an actuator comprising two braking pistons slidably disposed in said valve bridge between an inoperative position and an operative position; in said inoperative position, a gap being formed between said valve bridge and each of the two valves for skipping the motion from the lower portion of the cam, and in said operative position, a linkage being formed between said valve bridge and each of the two valves so that the motion from the whole cam can be transmitted to the two valves; and (b) a flow control valve for supplying control fluid with two levels of pressure to said actuator, said two levels of pressure comprising a first level pressure and a second level pressure, and said first level pressure being lower than said second level pressure, wherein the flow control valve comprises:

a coil structure for controlling the on and off positions of the flow control valve;

a valve body having a first bore in communication with an inlet port, a second bore in communication with an outlet port, and a third bore in communication with a drain port adjacent to the coil structure;

a disc mounted in the first bore and separating the inlet port and the outlet port, said disc containing a central orifice;

a movable valve member disposed in the second bore and between said disc and a valve seat formed by the interface of the second bore and the third bore; and a plunger slidably disposed in the third bore, said plunger biasing the valve member away from the valve seat but against said disc to seal the central orifice against the supply pressure of the control fluid from the inlet port when the flow control valve is at the off position.

12. The apparatus of claim 11 wherein said first bore has a sealed bottom end for reducing the up-lift force on the valve body by the supply pressure of the control fluid.

13. The apparatus of claim 11 wherein said valve member is a ball, said ball having its upper half enclosed in the second bore while its lower half exposed to the outlet port.

14. The apparatus of claim 11 wherein said disc further contains an off-center orifice, said off-center orifice being smaller than the central orifice and constantly in communication with the inlet port and the outlet port.

15. The apparatus of claim 11 wherein said flow control valve further comprising a pressure relief device for preventing the control fluid from leaking from the valve body to the coil structure, said pressure relief device comprising a 360° annular gap around the plunger so that the fluid pressure at the intersection of the third bore and the drain port approaches to the ambient pressure.

16. The apparatus of claim 11 wherein said flow control valve further comprising a pressure control device for keeping the control fluid in said braking fluid circuit at the first level pressure when the flow control valve is at the off position, and said pressure control device being installed in said drain port.

* * * * *